US008212727B2

(12) United States Patent
Hsu

(10) Patent No.: US 8,212,727 B2
(45) Date of Patent: Jul. 3, 2012

(54) ANTENNA AND WIRELESS TRANSCEIVER USING THE SAME

(75) Inventor: Chia-Jui Hsu, Hsinchu (TW)

(73) Assignee: Ralink Technology Corporation, Hsinchu (TW)

( * ) Notice: Subject to any disclaimer, the term of this patent is extended or adjusted under 35 U.S.C. 154(b) by 445 days.

(21) Appl. No.: 12/427,120

(22) Filed: Apr. 21, 2009

(65) Prior Publication Data

US 2010/0265141 A1 Oct. 21, 2010

(30) Foreign Application Priority Data

Apr. 21, 2008 (TW) ..... 97114435 A

(51) Int. Cl.
*H01Q 1/24* (2006.01)

(52) U.S. Cl. ..... 343/702; 343/841

(58) Field of Classification Search ..... 343/700 MS, 343/702, 846, 841; 455/575.7
See application file for complete search history.

(56) References Cited

U.S. PATENT DOCUMENTS 4,554,552 A * 11/1985 Alford et al. ..... 343/786
4,571,593 A * 2/1986 Martinson ..... 343/783
4,922,259 A * 5/1990 Hall et al. ..... 343/700 MS
5,363,105 A * 11/1994 Ono et al. ..... 342/20
5,990,838 A * 11/1999 Burns et al. ..... 343/702
6,417,809 B1 * 7/2002 Kadambi et al. ..... 343/702
6,563,466 B2 * 5/2003 Sadler et al. ..... 343/702
7,890,064 B1 * 2/2011 Rofougaran ..... 455/84

FOREIGN PATENT DOCUMENTS

TW 200715642 4/2007

* cited by examiner

*Primary Examiner* — Michael C Wimer
(74) *Attorney, Agent, or Firm* — Peter F. Corless; Steven M. Jensen; Edwards Wildman Palmer LLP

(57) ABSTRACT

An antenna and a wireless transceiver are provided. The antenna includes: a substrate having first and second surfaces with circuits thereon; and two shield boxes located on the first and second surfaces for covering the circuits thereon. The shield boxes each comprise an antenna section and a shield section. The antenna sections are disposed at one side of the shield section and aligned with a margin of the substrate, and include signal ends electrically connected to the circuits and grounding ends electrically connected to the shield sections. The first antenna section is disposed on a diagonal opposite of the second antenna section flush with substrate margin or aligned with the substrate margin, thereby maximizing the distance between the two antennas disposed on the substrate, and preventing the two antennas from electromagnetic interference. The antennas are disposed on sides of the shield sections flush with substrate margins and thereby are space-saving.

16 Claims, 4 Drawing Sheets

ANTENNA AND WIRELESS TRANSCEIVER USING THE SAME

BACKGROUND OF THE INVENTION

1. Field of the Invention

This invention generally relates to antennas and wireless transceivers, and more specifically, to an antenna and a wireless transceiver applicable to wireless communications.

2. Description of Related Art

Antennas are essential to wireless communications. To meet users' demands, antenna circuits have a trend toward small size, high performance, wide bandwidth, high reception quality, etc. as far as technology development is concerned.

To effect high performance and wide bandwidth in a small-sized receiving device, the distance between the receiver and the source of electromagnetic interference is becoming shorter. The electromagnetic interference is unavoidable when the antenna and the circuits are operated concurrently. Since electromagnetic force is generated within different frequencies or a band due to discontinuous or continuous changes in voltage or current, the electromagnetic interference commonly happens while an electronic device or an electronic equipment is operating, and the generated electromagnetic force may interfere with another electronic device by conductor transmission or radiation;

Therefore, designers in the wireless communication industry endeavor to overcome the interference and the noise between various components inside an antenna.

At present, there are some methods for suppressing electromagnetic interference; one of the methods involves using a shield box to cover circuits and suppress electromagnetic interference between the antenna and the circuit, and further electrically connecting the circuits with receiving end of the antenna via a line, thereby enabling the circuits to be disposed in a small-sized receiving device capable of receiving/transmitting wireless electromagnetic signals while operating in a wide bandwidth and high performance surroundings.

For prior art related to application of a shield box for suppressing interference between an antenna and circuits, please refer to Taiwan Patent Publication No. 200715642: "Antenna and Method for Fabricating the Same" and FIG. 1 in the specification of the present invention. An antenna 10 disclosed by Taiwan Patent Publication No. 200715642 comprises a shield plate 11 and an antenna plate 12, wherein a plurality of foldable plates are disposed alongside the shield plate 11, and a shield cover wireless module is formed to function as an electromagnetic shielding cover and system grounding by bending vertically the foldable plates and along with the shield plate 11 and allowing the antenna plate 12 to be connected to the margin of the shield plate 11 so as for the antenna plate 12 and the shield plate 11 to be integral to the antenna 10.

According to application of products complying with IEEE 802.11a/b/g/n standards, a multiple input/output transmission system is required to operate coordinately, and thus there are always more than two antennas in use. However, if any two antennas are too close to each other, severe electromagnetic interference happens, and thus reception quality is compromised. Also, antennas takes up space inside a device, and the antennas may be inefficiently arranged to the detriment of the arrangement of other components inside the device to thereby render the otherwise compact device bulky.

Hence, it is an urgent issue in the industry to provide a technique of avoiding electromagnetic interference otherwise prevalent among two or more antennas positioned closely to one another and avoiding inefficient arrangement of antennas.

SUMMARY OF THE INVENTION

In view of the disadvantages of the prior art mentioned above, it is a primary objective of the present invention to provide an antenna and a wireless transceiver so as to avoid electromagnetic interference otherwise prevalent among two or more said antennas positioned closely to one another.

Another objective of the present invention is to provide an antenna and a wireless transceiver conducive to efficient arrangement of the antennas and miniaturization of the device.

To achieve the aforementioned and other objectives, an antenna and a wireless transceiver are provided according to the present invention. The antenna according to the present invention comprises: a first radiator located on a side of a first shield box and aligned with a margin of a substrate, wherein the first radiator comprises a first end electrically connected to the circuits and a second end electrically connected to the first shield box.

In one embodiment of the present invention, the antenna further comprises a second shield box disposed on a second surface of the substrate opposing the first surface for covering circuits laid on the second surface of the substrate; a second radiator located on a side of the second shield box and aligned with another margin of the substrate, wherein a first end of the second radiator is electrically connected to the circuits and a second end of the second radiator is electrically connected to the second shield box.

In another embodiment of the present invention, the first radiator and the second radiator are diagonally disposed Compared with the prior art, the present invention discloses an antenna with a first radiator disposed on diagonal opposite of the second radiator flush with a margin of a substrate, thereby maximizing the distance between the two antennas disposed on the substrate, and also avoiding electromagnetic interference among a plurality of antennas positioned closely to one another, and further enhancing reception quality; meanwhile, the radiators are disposed on sides of the shield sections flush with the substrate margins, so as to avoid inefficient arrangement of antennas and downsize a device equipped with the antennas.

BRIEF DESCRIPTION OF DRAWINGS

The present invention can be more fully understood by reading the following detailed description of the preferred embodiments, with reference made to the accompanying drawings, wherein.

DETAILED DESCRIPTION OF PREFERRED EMBODIMENTS

The following illustrative embodiments are provided to illustrate the disclosure of the present invention. Those skilled in the art can apparently understand these and other advantages and effects of the present invention after reading the disclosure of this specification. The present invention can also be performed or applied by other different embodiments. The details of the specification are subject to different points and applications, and numerous modifications and variations can be made in the present invention without departing from the spirit of the present invention.

The following embodiments provide detailed descriptions of viewpoints of the present invention; however, the scope of the present invention is not restricted to any viewpoint described herein.

Figure 1:
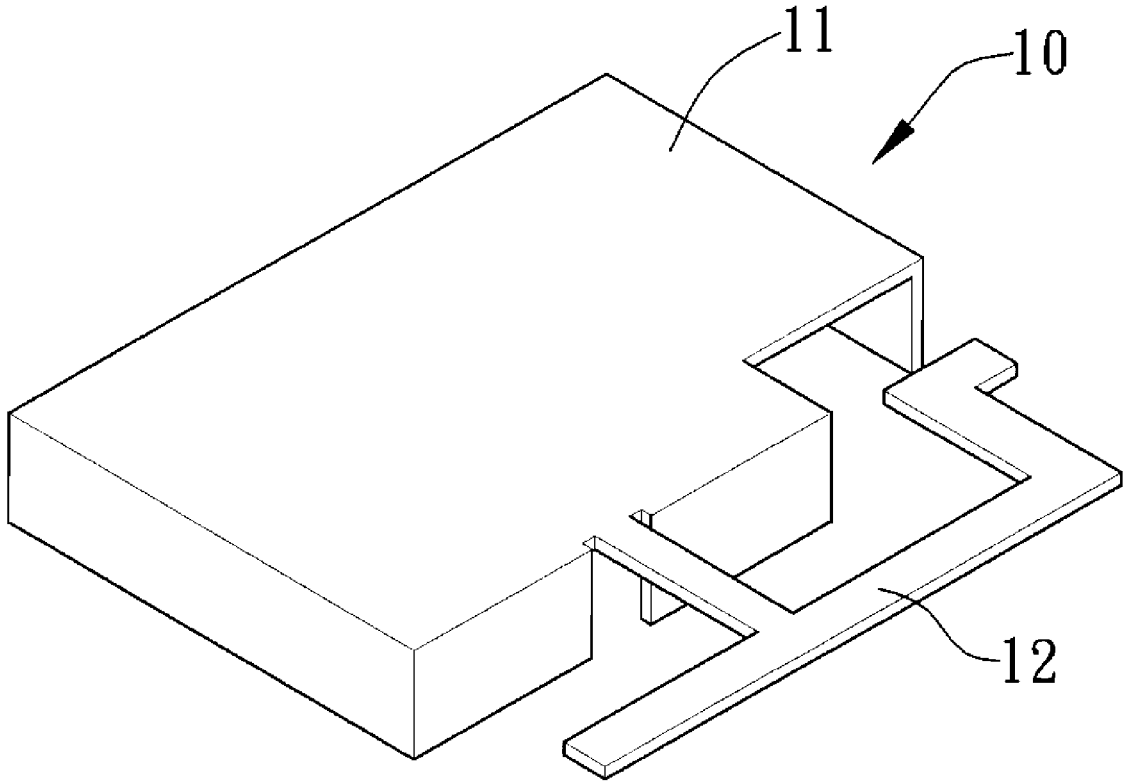
FIG. 1 (PRIOR ART)
FIG. 1 is a perspective view of a conventional antenna.
Figure 2:
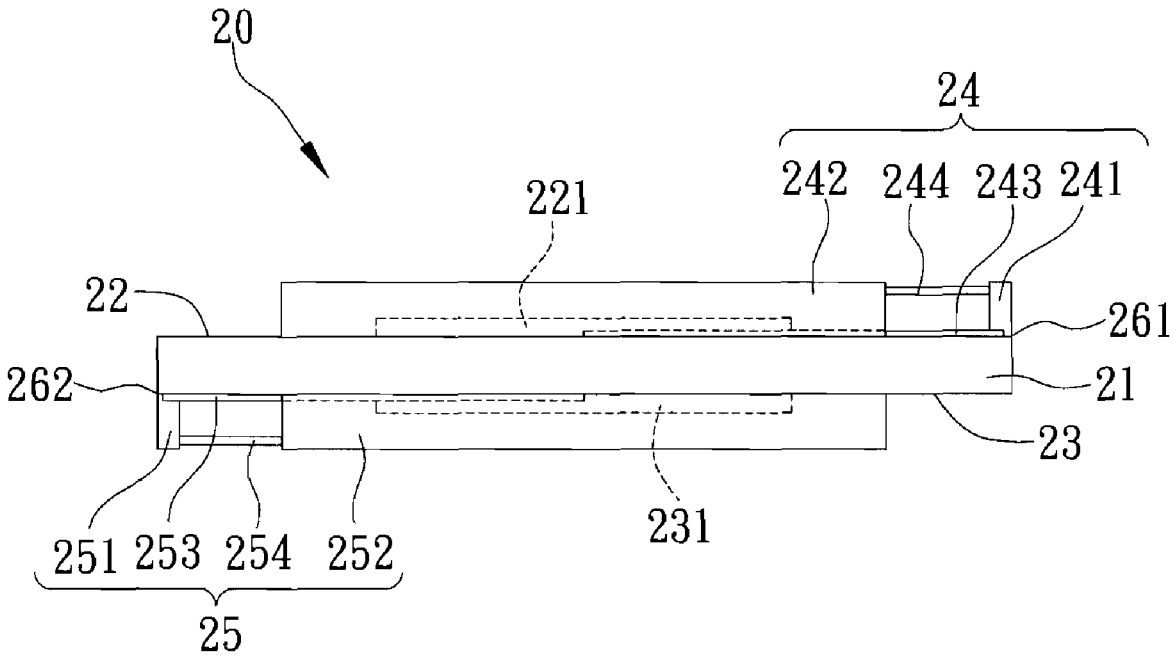
FIG. 2 is a cross-sectional view of an antenna according to an embodiment of the present invention.
Figure 3:
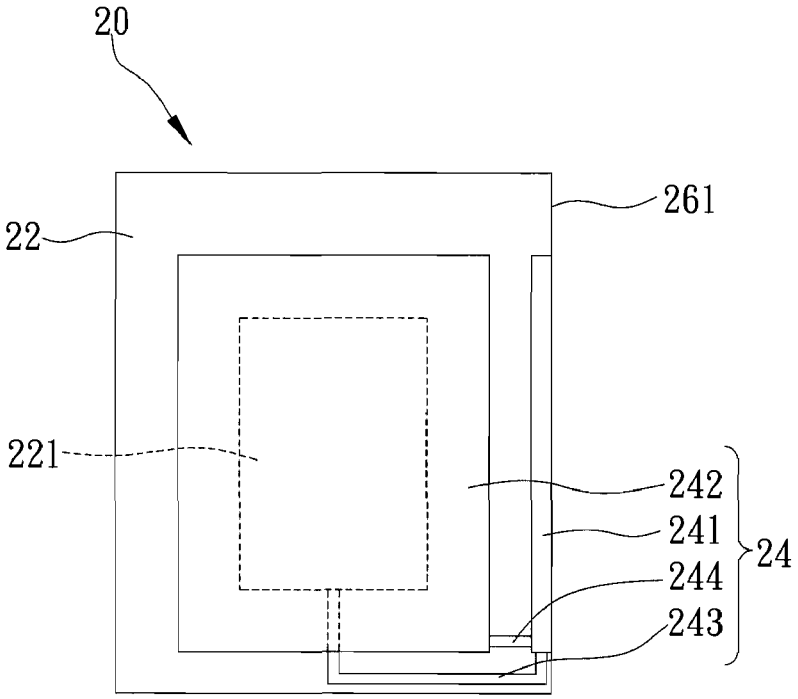
FIG. 3 is a top view of the antenna to be illustrative of a first surface thereof according to an embodiment of the present invention.
Figure 4:
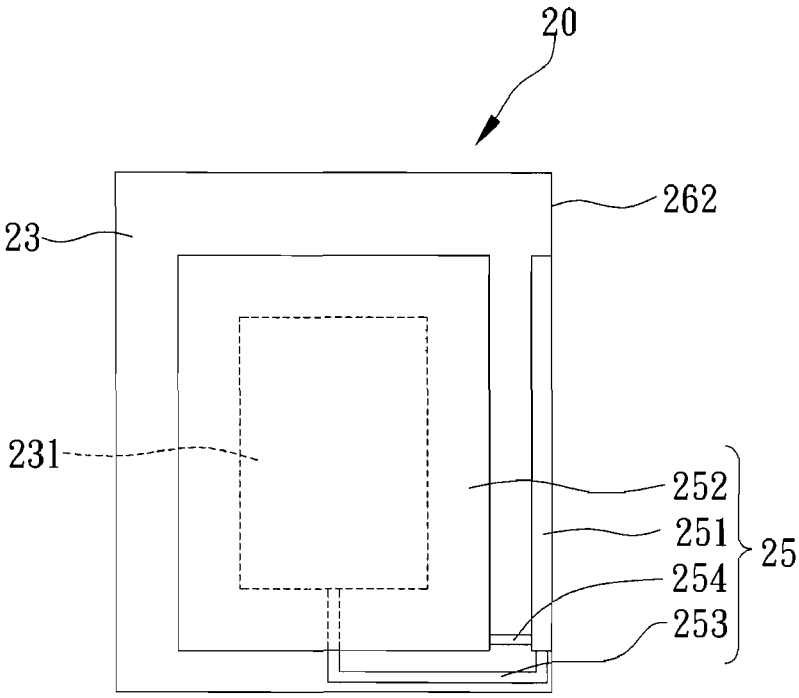
FIG. 4 is a top view of the antenna to be illustrative of a second surface thereof according to an embodiment of the present invention.
Figure 5:
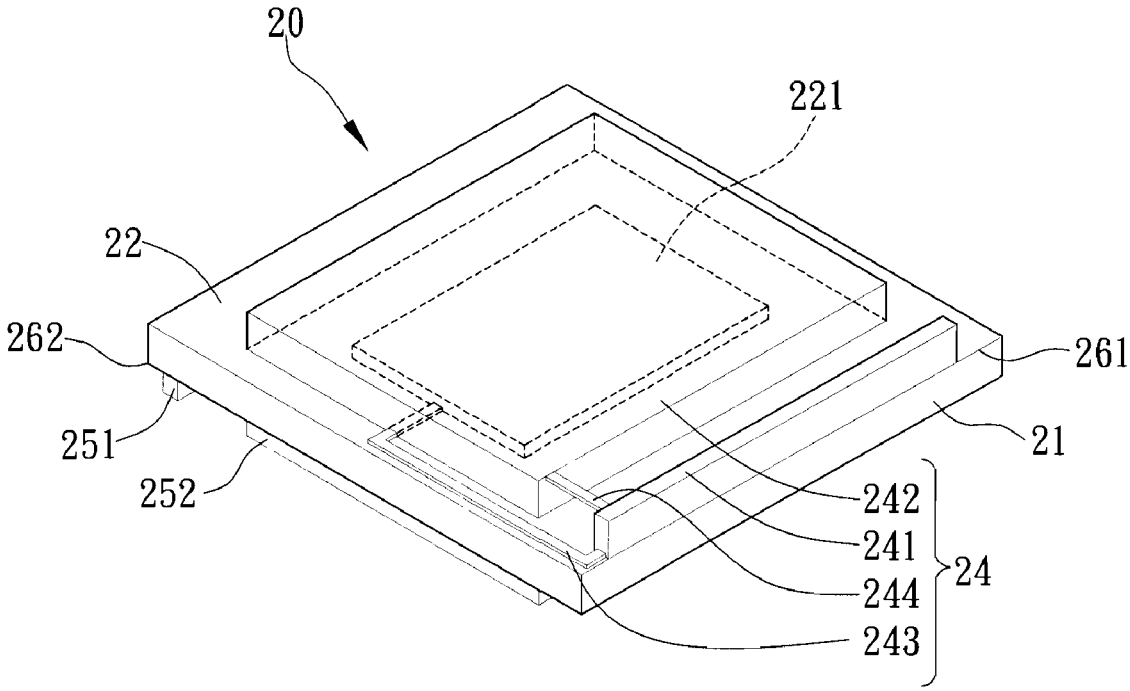
FIG. 5 is a perspective view of the antenna to be illustrative of the first surface thereof according to an embodiment of the present invention.
Figure 6:
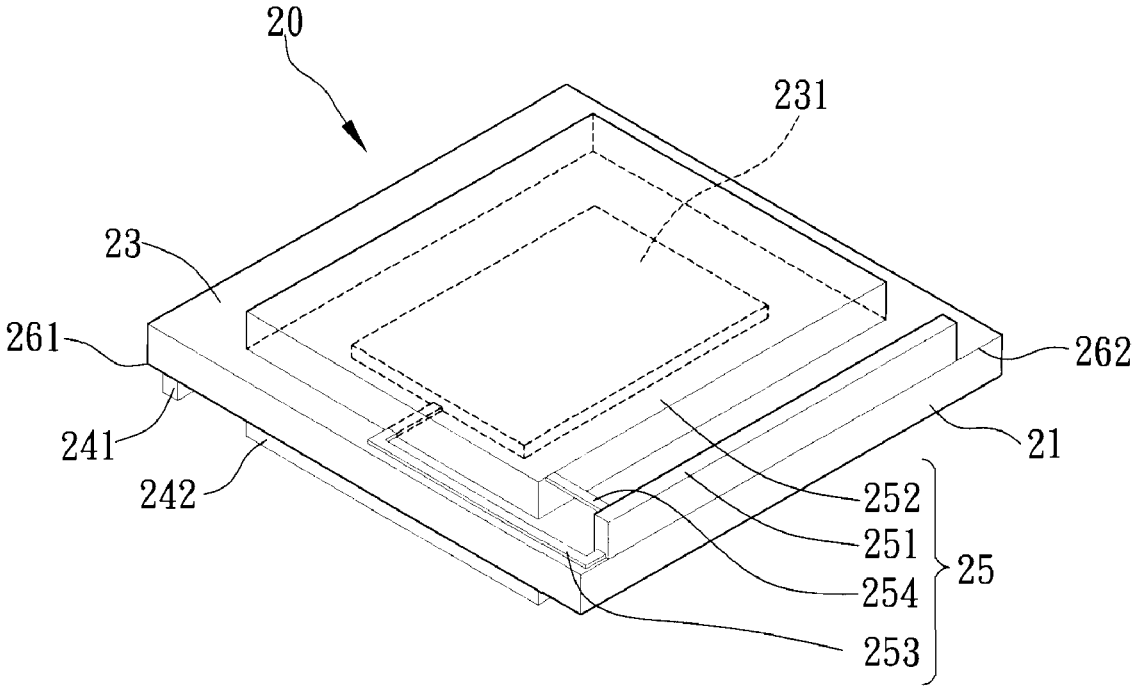
FIG. 6 is a perspective view of the antenna to be illustrative of the second surface thereof according to an embodiment of the present invention.

The present invention is illustrated with FIGS. 2 through 6. FIG. 2 is a basic architecture diagram of an antenna of the present invention. FIGS. 3 through 6 are diagrams of the antenna of the present invention when viewed from different angles. As shown in the drawings, the present invention provides an antenna 20 comprising at least: a substrate 21 (exemplified by a printed circuit board (PCB) having a first surface 22 and a second surface 23 opposite to the first surface 22, wherein the first surface 22 and the second surface 23 are laid with a first circuit 221 and a second circuit 231 respectively; and a first antenna shield box 24 and a second antenna shield box 25, which are separated disposed on the first surface 22 and the second surface 23 for covering the first circuit 221 and the second circuit 231 respectively; besides, the first antenna shield box 24 further comprises a first radiator 241, e.g. an inverted F antenna, and a first shield section 242, and the second antenna shield box 25 further comprises a second radiator 251, for example, an inverted F antenna, and a second shield section 252. The length of the radiators decides radio resonance frequency.

In the present invention, preferably, the second surface 23 is located on the opposite side of the first surface 22.

Each radiator is located on a side of a corresponding one of the shield sections as follows: the first radiator 241 is located on a side of the first shield section 242 flush with a substrate margin 261; and the second radiator 251 is located on a side of the second shield section 252 flush with a substrate margin 262. Each radiator further comprises a signal end and a grounding end. The first radiator 241 comprises a first signal 243 and a grounding end 244. The second radiator 251 comprises a second signal end 253 and a second grounding end 254.

Each signal end is electrically connected to a corresponding one of circuits; specifically speaking, the first signal end 243 is electrically connected to the first circuit 221, and the second signal end 253 is electrically connected to the second circuit 231. Each grounding end is electrically connected to a corresponding one of the shield sections; specifically speaking, the first grounding end 244 is electrically connected to the first shield section 242, and the second grounding end 254 is electrically connected to the second shield section 252.

The substrate margin 261 flush with the first radiator 241 is diagonal opposite of the substrate margin 262 flush with the second radiator 251, namely, the first radiator 241 of the present invention is disposed on diagonal opposite of the substrate margin 262 flush with the second radiator 251, accordingly, the two antennas are disposed on two opposite sides of the substrate, thereby maximizing the distance between the two disposed antennas.

Regarding the antenna 20 of the present invention, the first radiator 241 is disposed on diagonal opposite of substrate margin 262 flush with the second antenna 251, thereby providing a maximum distance between the two disposed antennas, and protecting a plurality of antennas closely arranged from electromagnetic interference, and further enhancing reception quality. Each radiator is disposed on a side of a corresponding one of the shield sections flush with the substrate margin or aligned with a margin of the substrate, thereby avoiding the antennas from taking up excessive space due to inefficient arrangement of the antennas.

The antenna of the present invention can be utilized in a wireless communication apparatus, such as a wireless transceiver. According to an embodiment of the present invention, the wireless transceiver comprises a processor and the antenna mentioned above. The processor is used to process the signals to be transmitted by the antenna, or the signals received by the antenna.

Meanwhile, testing via a network analyzer on multiple input/output system of said two antennas of the present invention within the wireless local area network complying with IEEE 802.11a/b/g/n standards, with said two antennas of the system being separately disposed on two diagonally opposite sides, an S parameter derived from the testing shows that reflection loss on both antennas is below −10 dB within wireless local area network frequency band, namely, the two antennas of the present invention are well isolated, Max. −13.9 dB.

In view of the above, according to the antenna of the present invention, the first radiator is disposed on diagonal opposite of the substrate margin flush with the second radiator, thereby providing a maximum distance between dispositions of the two antenna on the substrate, and preventing a plurality of antennas positioned proximate to one another from electromagnetic interference, and then further enhancing reception quality; meanwhile, since the radiators are disposed on sides of the shield sections flush with substrate margins or aligned with a margin of the substrate, thereby avoiding the antennas from taking up excessive disposition space.

The foregoing descriptions of the detailed embodiments are only illustrated to disclose the features and functions of the present invention and not restrictive of the scope of the present invention. It should be understood to those in the art that all modifications and variations according to the spirit and principle in the disclosure of the present invention should fall within the scope of the appended claims.

What is claimed is:

1. An antenna, comprising:

a substrate having a first surface disposed with circuits;

a first shield box disposed on the first surface of the substrate for covering the circuits;

a first radiator located on a side of the first shield box and aligned with a margin of the substrate, wherein the first radiator is perpendicular to the substrate and comprises a first end electrically connected to the circuits and a second end electrically connected to the first shield box;

a second shield box disposed on a second surface of the substrate opposing the first surface for covering circuits disposed on the second surface of the substrate; and a second radiator located on a side of the second shield box and aligned with another margin of the substrate, wherein a first end of the second radiator is electrically connected to the circuits and a second end of the second radiator is electrically connected to the second shield box.

2. The antenna of claim 1, wherein the first radiator and the second radiator are diagonally disposed.

3. The antenna of claim 1, which complies with IEEE standard.

4. The antenna of claim 1, which is a multiple input/output system.

5. The antenna of claim 1, wherein the substrate is a printed circuit board.

6. The antenna of claim 1, wherein the first radiator is an Inverted F Antenna.

7. The antenna of claim 1, wherein the second radiator is an Inverted F Antenna.

8. The antenna of claim 1, wherein lengths of the first radiator and the second radiator decide radio resonance frequency.

9. A wireless transceiver, comprising:

a substrate having a first surface disposed with circuits;

a processor electrically connected to the circuits on the first surface of the substrate;

a first shield box disposed on the first surface of the substrate for covering the circuits;

a first radiator located on a side of the first shield box and aligned with a margin of the substrate, wherein the first radiator is perpendicular to the substrate and comprises a first end electrically connected to the circuits and a second end electrically connected to the first shield box;

a second shield box disposed on a second surface of the substrate opposing the first surface for covering circuits disposed on the second surface of the substrate; and a second radiator located on a side of the second shield box and aligned with another margin of the substrate, wherein a first end of the second radiator is electrically connected to the circuits and a second end of the second radiator is electrically connected to the second shield box.

10. The wireless transceiver of claim 9, wherein the first radiator and the second radiator are diagonally disposed.

11. The wireless transceiver of claim 9, which complies with IEEE standard.

12. The wireless transceiver of claim 9, which is a multiple input/output system.

13. The wireless transceiver of claim 9, wherein the substrate is a printed circuit board.

14. The wireless transceiver of claim 9, wherein the first radiator is an Inverted F Antenna.

15. The wireless transceiver of claim 9, wherein the second radiator is an Inverted F Antenna.

16. The wireless transceiver of claim 9, wherein lengths of the first radiator and the second radiator decide radio resonance frequency.

* * * * *